US005566829A

United States Patent [19]

Cotilletta

[11] Patent Number: 5,566,829

[45] Date of Patent: Oct. 22, 1996

[54] COSMETIC TESTER MODULE

[76] Inventor: Joseph Cotilletta, 130 Broadway, Cresskill, N.J. 07624

[21] Appl. No.: 488,904

[22] Filed: Jun. 9, 1995

[51] Int. Cl.[6] ..... B65D 83/06

[52] U.S. Cl. ..... 206/581; 132/286; 132/314; 206/823; 221/25

[58] Field of Search ..... 132/286, 314; 206/229, 569, 581, 820, 823; 221/25; 422/61, 102

[56] References Cited

U.S. PATENT DOCUMENTS

| | | | |
|---|---|---|---|
| 2,185,386 | 1/1940 | Valentine | 206/823 |
| 3,267,623 | 8/1966 | Block | 206/820 |
| 4,805,773 | 2/1989 | Sabongi | 206/823 |
| 4,884,719 | 12/1989 | Levine et al. | 221/25 |
| 5,031,647 | 7/1991 | Seidler | 206/581 |

*Primary Examiner*—Jimmy G. Foster

[57] ABSTRACT

A tester module to provide a sanitary apparatus to test make-up without causing discardable waste comprises a housing having a supply reel with cosmetic samples located on a wound-up tape at predetermined intervals along the tape. The housing also includes a curved member guide adjacent an aperture in the upper wall portion of the housing and a take-up reel in the lower portion of the housing. The take-up reel is periodically advanced by a crank in one embodiment to expose a cosmetic sample through the housing aperture. A user places her finger through the aperture to transfer the cosmetic from the strip to her finger and then moves the tape from the supply reel to the next position feeding the used material to the take-up reel within the housing. In a second embodiment, a window over the housing aperture is coupled to a gear arrangement to automatically index the used tape when a spring backed window is closed. The window is opened by the consumer to provide access to the new sample which moves into position. The entire module is replaced and/or reloaded when the supply reel is empty.

11 Claims, 5 Drawing Sheets

12
10
10
10
10

80
81
82
83
84
85
86
87
88
89
90
94
95
96
97
98
99
100
101
102
103
104
105
106
107
108

COSMETIC TESTER MODULE

BACKGROUND OF THE INVENTION

In the sale of cosmetics, it was at one time common to have open jars of the cosmetic on a counter for prospective purchasers to sample. With the concern over communicable diseases and the general unsanitary nature of multiple uses of the same product by different individuals, various sampling devices were developed.

A common cosmetic sampling device involved a plurality of tear-off strips, each having a sample located thereon. The strips would be mounted on a roller and ripped off by a user. The cosmetic would be applied and the strip discarded. Unfortunately, the strips often ended up on the floors and store fixtures. Make-up dust and residue stains were typical problems.

The prior art also discloses various attempts to solve the cosmetic sampling problem. U.S. Pat. No. 5,031,647 to Seidler discloses a cosmetic sampler applicator which comprises an elongated member having product located in a recessed walled portion.

U.S. Pat. No. 4,884,719 discloses a dispensing strip similar to that discussed above wherein cosmetic samples such as nail enamel, lipstick, powder or cream make-up, fragrance and the like are mounted on a strip with perforations therebetween to facilitate tearing off samples. The present invention is designed particularly to overcome the deficiencies of this patent and the prior art in general. The invention provides a sanitary sampling means with discardable modules to eliminate the random accumulation of waste product.

Other patents of interest are U.S. Pat. Nos. 4,876,136; 4,998,621; 4,739,779 and 4,824,143. None of these patents disclose the unique cosmetic tester module proposed herein which appears patentable over the known prior art.

SUMMARY OF THE INVENTION

This invention relates to testing devices and particularly to cosmetic testing or sampling devices.

The tester module of the present invention provides a device wherein a cosmetic sample is mounted on a rolled tape within a housing and is advanced adjacent an aperture in the housing to be accessible to a user. The tape with the used residue is fed to a take up reel within the housing preferably with the clean side facing out.

After the sample is applied, an individual operates a crank, driving the take up reel to advance another sample into position for use. In another embodiment, closing a window over the sample drives a gear segment to advance the sample roll automatically. The sample strip is normally mounted on a supply reel within the housing and the strip is advanced over a curved member adjacent the aperture onto a take-up reel. The take-up reel includes a plurality of concentrically spaced openings which are engaged by a spring urged crank to move the strip forward.

In operation, the tape strip with a cosmetic sample is exposed through an aperture in the side wall of the module housing. The individual removes the sample from the tape which is backed by a curved member for support. After the sample is used, the take-up reel is driven by the crank to move another sample into view. The used sample strip is wound on the take-up reel rather than discarded on the floor. Cosmetic dust and debris accumulate at the base of the module and are discarded along with the used strip. The strip may include perforations along one or both sides which are engaged by sprockets for purposes of moving the strip.

In an alternate embodiment, a window over the housing aperture is coupled to a gear arrangement which automatically indexes the sample laden tape when the window is closed. The entire module is replaced and/or reloaded when the supply reel is empty.

Accordingly an object of this invention is to provide a new and improved cosmetic tester module and apparatus.

A further object of this invention is to provide a new and improved sanitary cosmetic testing and sampling device.

A still further object of this invention is to provide a new and improved cosmetic testing apparatus and method wherein tapes with samples are retained in a closed discardable housing after use.

A more specific object of this invention is to provide a new and improved cosmetic testing device wherein a plurality of samples are mounted on a tape reel within a housing and periodically advanced to an opening for use and then to a take-up reel where the spent tape is accumulated for disposal.

DESCRIPTION OF THE DRAWINGS

The above and other objects and advantages of this invention may be more clearly seen when viewed in conjunction with the accompanying drawings wherein.

DETAILED DESCRIPTION OF THE DRAWINGS

Figure 1:
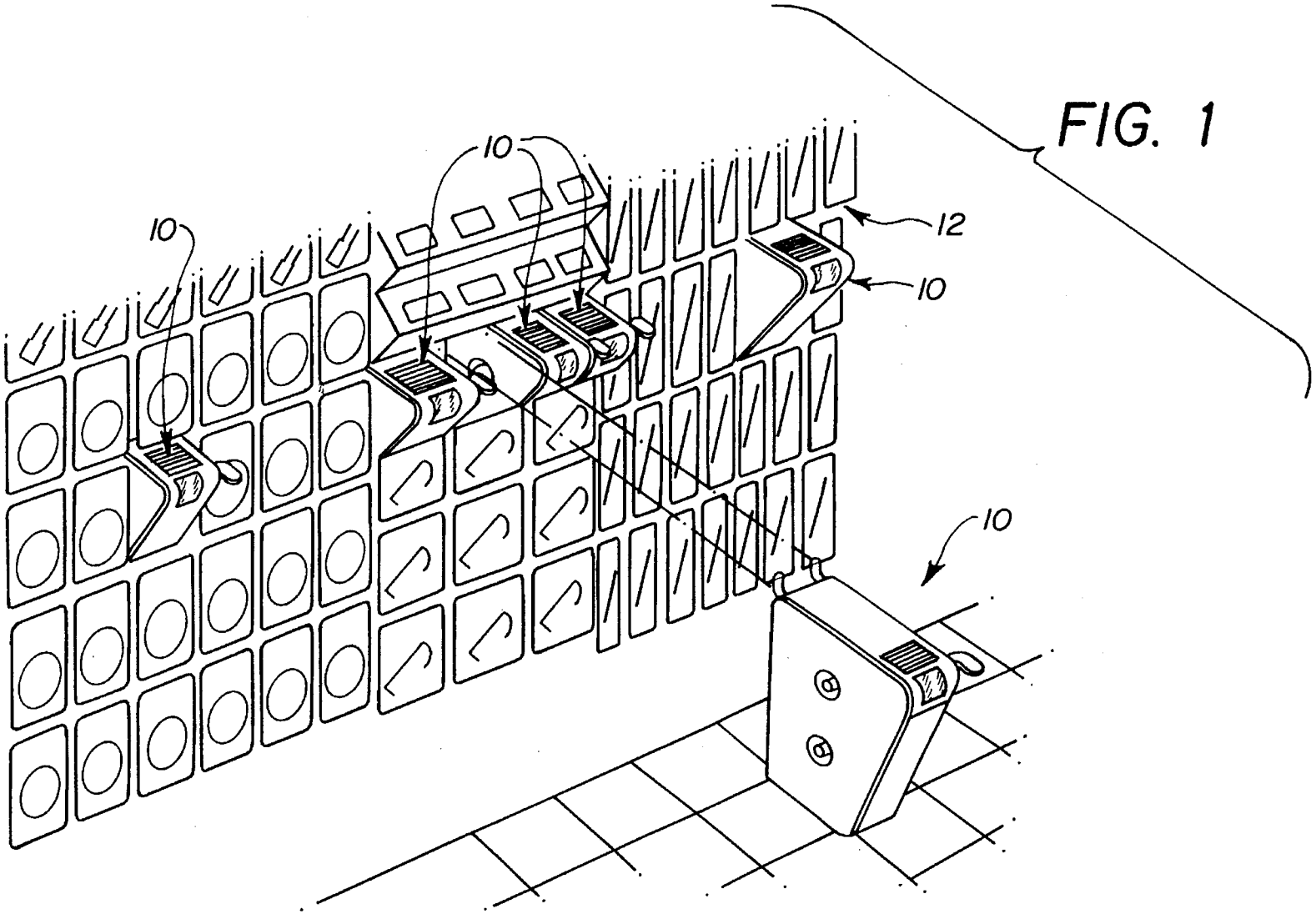
FIG. 1 is a perspective view of the tester module comprising the invention shown in the context of a bank of tester modules.

Referring now to the drawings, the invention comprises a tester module 10 which provides a sanitary means to test or sample cosmetics 11. The module 10 is generally mounted in a console or array 12 with plurality of similar modules 10 generally reflecting different product shades. An individual samples the product 11 which is mounted on a tape or strip 15 from reel 13 and is accessible through aperture 14 in the housing 16. The module 10 eliminates the problem of discardable waste since the tape 15 is fed to a take up reel 17 within the housing 16 which is periodically replaced. Cosmetic dust and other debris collect on the base 18 of the housing 16. While the invention is described mainly with regard to cosmetic samples, it may also be used for fragrances and such varied cosmetics such as make-up, lipstick, creams, or nail enamels.

Figure 2:
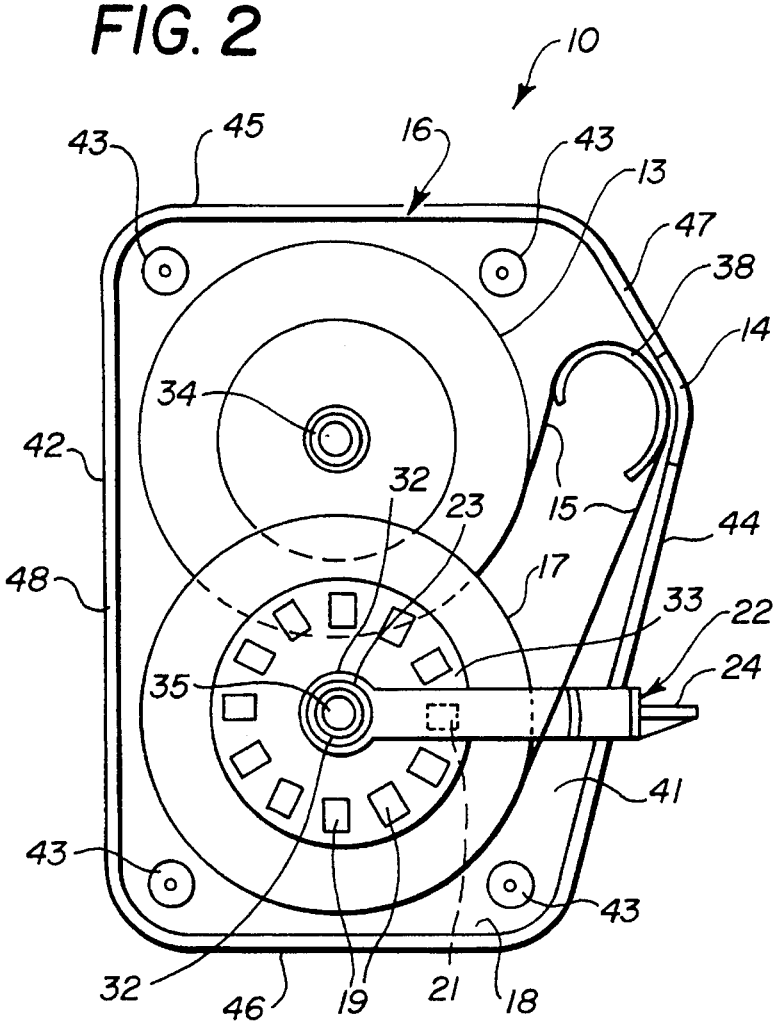
FIG. 2 is a front view of the invention with the cover removed.
Figure 3:
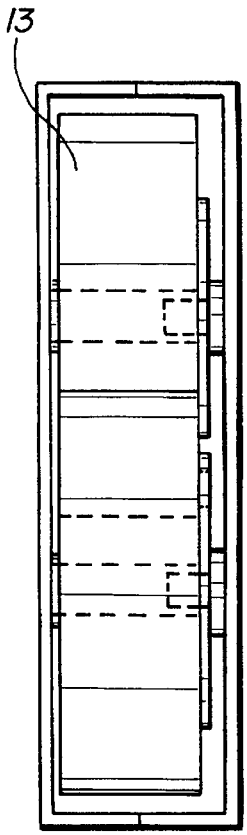
FIG. 3 is a side view of the module shown in FIG. 2.
Figure 4:
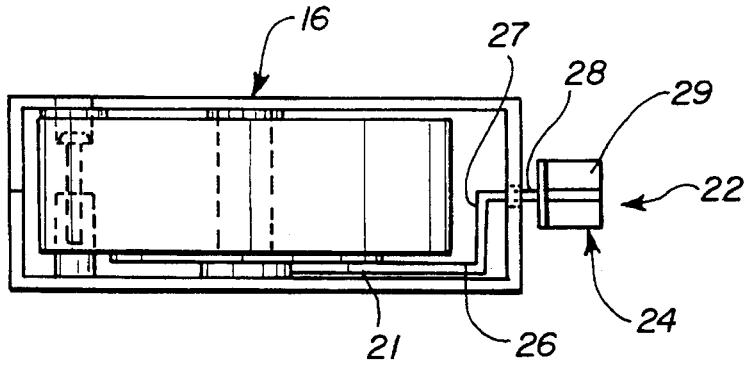
FIG. 4 is a bottom view of the module shown in FIG. 2.
Figure 5:
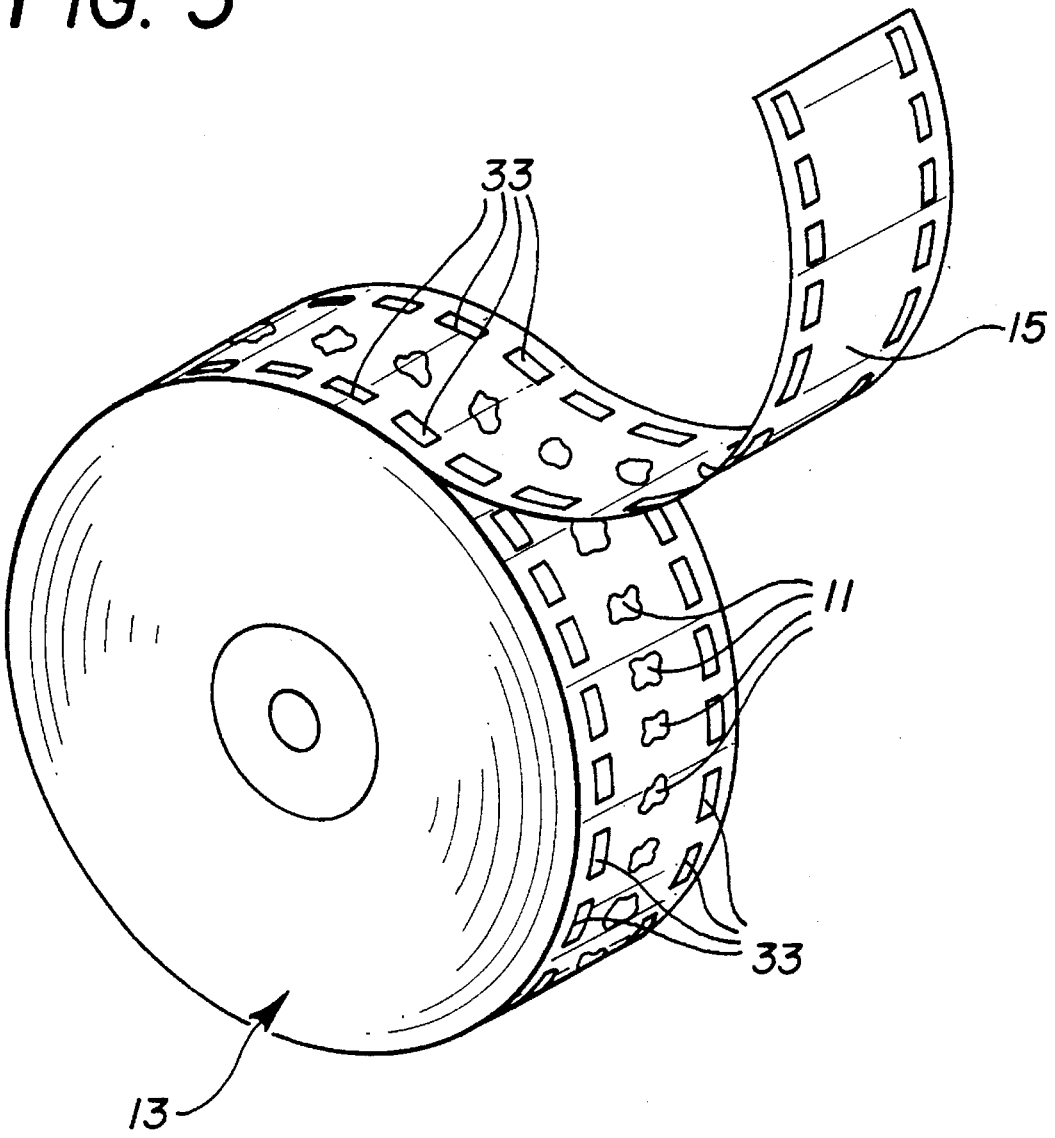
FIG. 5 is a perspective view of the tape reel with samples deposited thereon at predetermined intervals.

As shown in FIG. 2, which discloses the module 10 with the cover 20 removed, the invention comprises a tape supply reel 13 and a take-up reel 17 rotatably mounted in the housing 16. The take-up reel 17 includes a plurality of apertures 19 concentrically spaced about the reel 17 or a concentrically mounted wheel. A typical arrangement includes 12 rectangular apertures 19. The apertures 19 are engaged by a protrusion 21 on the irregularly shaped crank 22 to index the tape 15 to present a new sample 11 at the window 14.

The crank 22 includes a circular aperture 23 at one end and an actuating handle 24 at the other end. The body portion 26 extending between the ends comprises an elongated rectangular member which includes a right angle portion 27 extending outwardly to a parallel extension 28 leading to the handle 24. The handle 24 includes a transverse portion 29 extending at right angles to the extension 28 at the mid-point 31 thereof. The extension 28 and the transverse portion 29 extend outwardly from the housing 16. The crank 22 also includes a protrusion 21 extending outwardly from the body portion 26 to engage the apertures 19 in the reel 17 for indexing purposes. The reel 13 is normally held in position by a torsion spring 32 which is overcome by the force applied to the crank 22.

The tape reel 13 includes a plurality of small deposits of cosmetics 11 mounted on the tape 15 at predetermined intervals. The tape 15 may include a plurality of perforations 33 along both sides similar to a camera film to aid in indexing. The reels 13 and 17 are mounted on central cylinders or shifts 34, 35 respectively, extending outwardly from the back-plate 36. The crank aperture 33 is mounted about cylinder 35. The tape 15 extends from the reel 13 over curved member 38 adjacent aperture 14 and then downwardly about the take-up reel 17. The curved member 38 provides support and guidance for the tape 15. It also provides backup when an individual contacts the cosmetic product 11.

The housing 16 comprises a base or side 41 with upwardly extending walls 42 and a cover 20 which mounts thereover secured by fastening means 43. The forward portion 44 of the cover 20 slopes outwardly from the parallel sides 45, 46 to form a visible wall section 47 with the aperture 14. The rear wall 48 of the cover is substantially at a right angle to the sides 45, 46 to permit stacking in an array 12.

In operation, the crank 22 is manually moved by exerting pressure on the handle 24. This overcomes the pressure of the spring 32 and moves the take-up reel 17 drawing the tape 15 off the supply reel 13. The user reaches the cosmetic 11 through the window 14 and indexes the reel 17 when an additional sample 11 is needed. If the user wishes to try a different sample, the individual merely selects a different module 10 in the array 12. After the tape 15 is expended, the entire module 10 may be discarded or the cover 20 may be removed and the reels 13 and 17 replaced after cleaning.

Figure 6B:
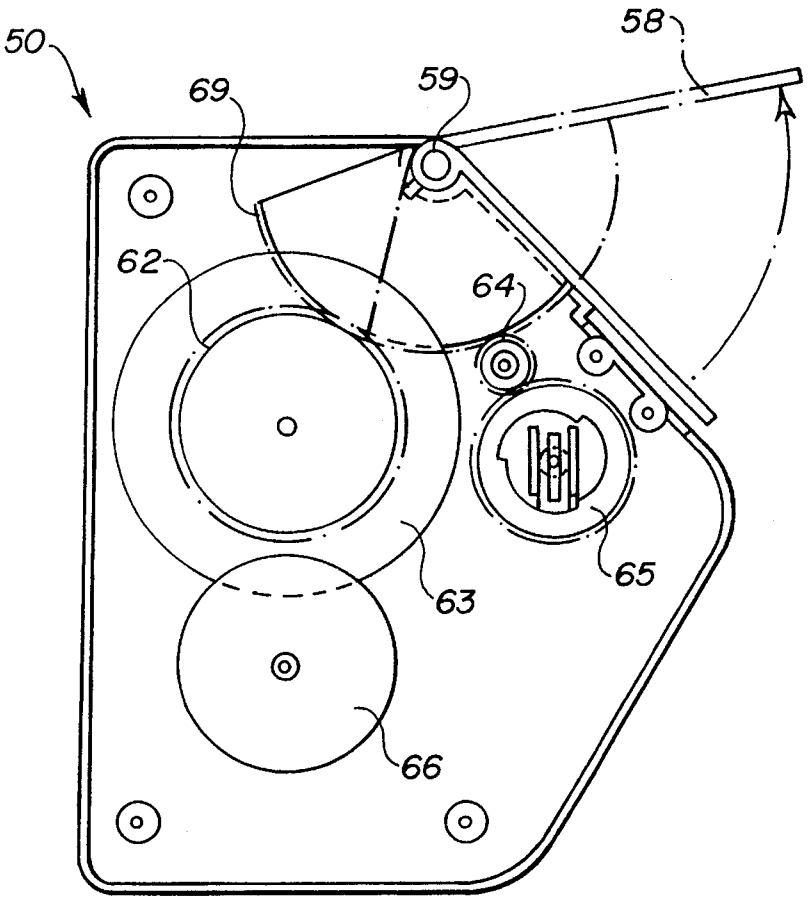
FIG. 6A represents an alternate embodiment of the invention wherein closing of the door as shown in FIG. 6B causes the tape reel to index to a new position; and, FIG. 7 is an exploded view of an alternate embodiment of the invention.
Figure 6A:
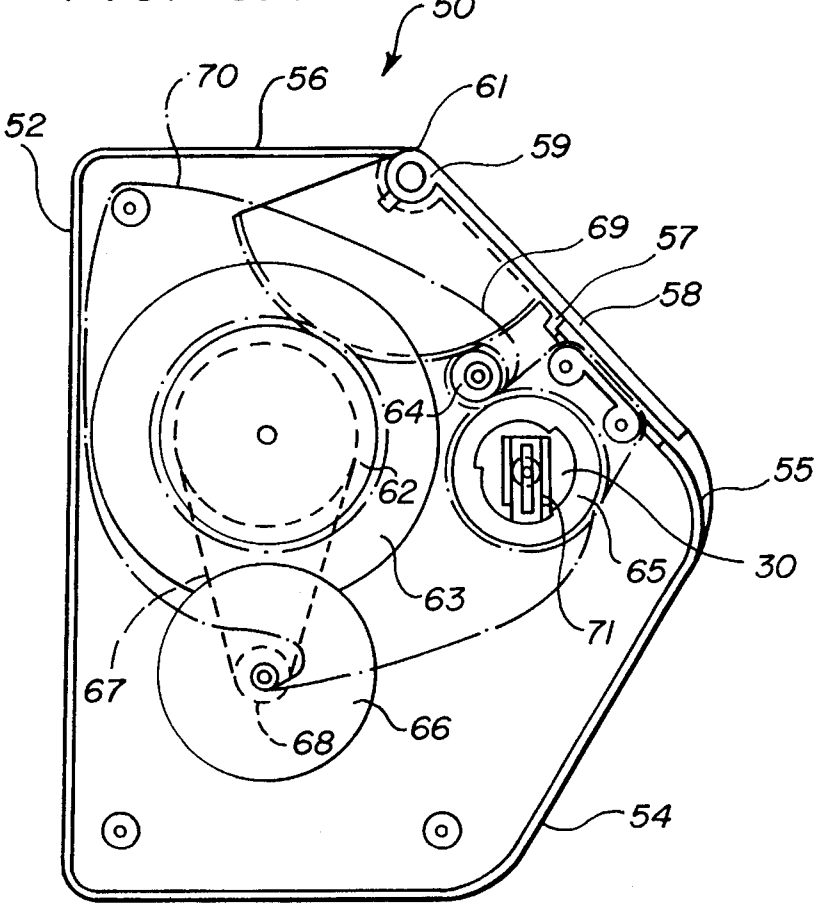

In the embodiment of FIGS. 6A and 6B, the module 50 comprises a rear wall 51 having outwardly projecting side walls 52, 53, 54, 55, and 56. The wall 55 includes an aperture 57 which is covered by the pivotal transparent window 58. The window 58 includes a circular end portion 59 which is mounted for rotation about the shaft 61. The window 58 includes a gear sector of approximately 96 teeth which engages both gear 62 on the product supply reel 63 and gear 64 which engages the tape drive 65. The tape driver 65 includes clutch gear 30 and clutch 72 which permit indexing of the strip 70 in one drive. A take up reel 66 is mounted adjacent the supply reel 63.

In operation, the window in 58 in FIG. 6A is lifted to the position of FIG. 6B closing the window 58. This drives gears 62 and 65. Band 66 is mounted about pulley 67 on product drum 63 and drives pulley 68 on waste reel 66 as gear 62 rotates. Gear 62 meshes with the gear segment 69 which pivots as the window 58 is raised to permit access to the tape 70 containing product samples 11.

The tape 70 is fed off the feed reel 63 past the backing member 71 about the drive 65 and then onto the waste roll 66. When the spring backed window 58 is released, the tape 70 indexes a new sample into position adjacent the window 58. When the feed wheel 63 is exhausted, the module 50 may be ejected and discarded. The tape 70 is preferably stored on the take up reel 66 with the clear side out.

In a still further embodiment, similar to FIG. 2, the crank 22 may be merely a handle which is coupled to a sprocket within the housing 16. The sprocket engages perforations along both edges of the tape 15 to index to reels 13, 17 and present a new sample 11 to the user.

Figure 7:
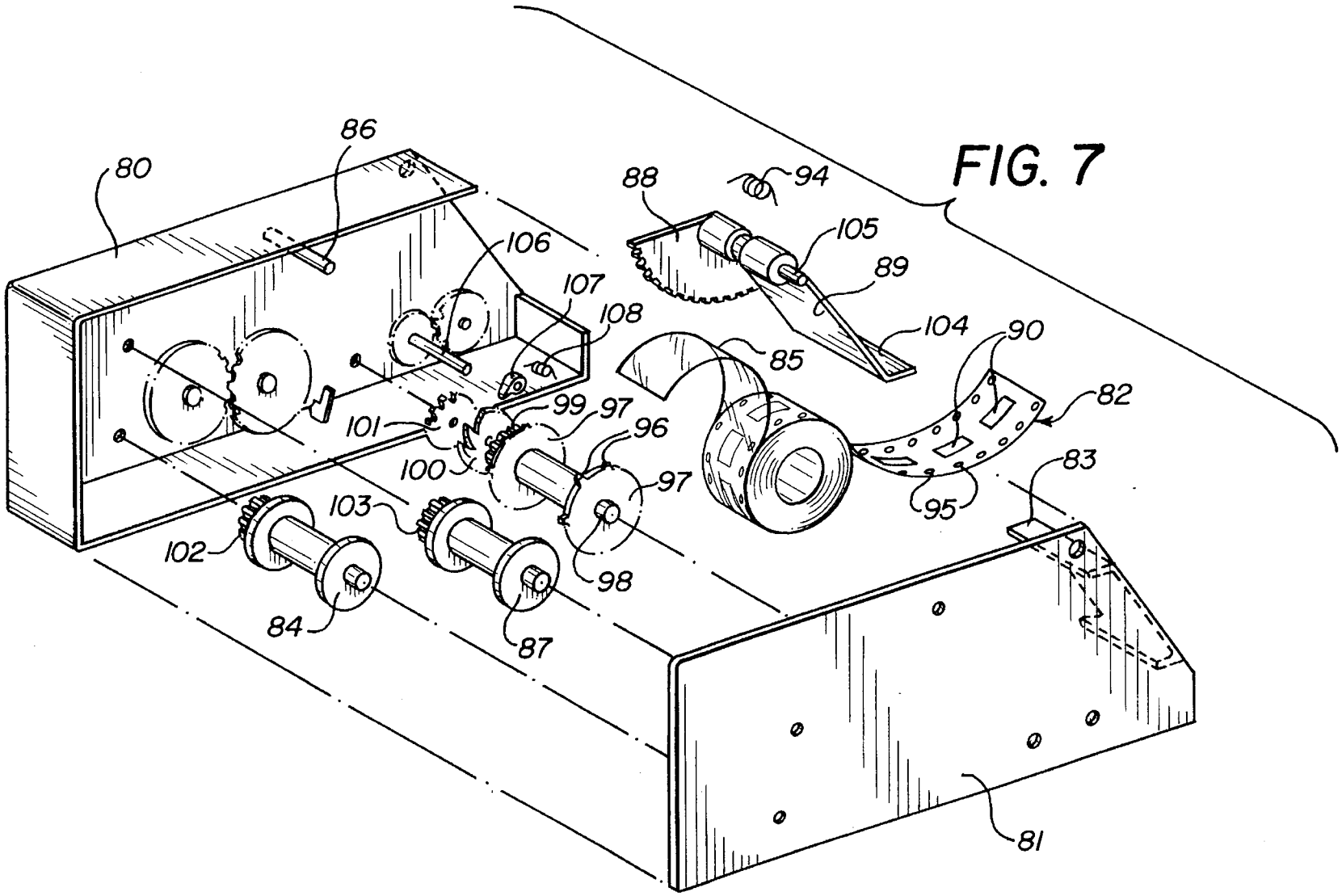

FIG. 7 depicts an alternate embodiment of the invention mounted in housing 80 with a removable cover 81. A supply reel 93 with the tester strip 82 mounted thereon feeds the strip 82 over the backing element 83 to the take up reel 84. The strip 82 is protected by a clear liner 85 which separates from the strip 82 during unwinding, moving over the roller bar 86 to the take up reel 87. The strip 82 is advanced by a gearing arrangement which includes the drive gear segment 88 coupled to the door 89 which swings up to open and advance the tester strip 82 past the backing element 83. Each opening of the door or window 89 advances a fresh sample 90 for access by a user and the door 89 then returns to a closed position under the urging spring 94.

The strip 82 includes a series of sprocket perforations 95 along both edges which engage the sprocket teeth 96 on the reel 97. The shaft 98 includes the sprocket reel 97 transfer gear 99, ratchet 100 and drive gear 101. The transfer gear 99 is engaged by the gear segment 88 to actuate the sprocket reel 97 and drive the take up reels 84, 87 with drive gear 101. Gears 102 and 103 are basically idler gears.

In operation, the door 89 is grasped by the handle 104 and raised about the pivot 105. The gear segment 88 which is mounted for movement about the pivot 105 moves when the door 89 is raised transferring the strip 82 to the take-up reel 84. The strip 82 is driven over the idler gear support 106 from the supply reel 107. A ratchet 100 and a pawl 107 with spring 108 prevent reverse motion when the door 89 is closed. The strip 82 passes the backing element 83 as it proceeds to the take up reel 84 while the liner 85 is wound on reel 87. Thus the strip 82 is automatically indexed by opening the door 89.

In this embodiment, a liner 85 is used to cover the tester strip 82 and protect the samples 90 during unwinding. Alternatively, the samples 90 could be protected by placement on the underside of the strip 82 so that they are protected by the plain side of the strip 82 during winding and unwinding.

While the invention has been explained by a detailed description, of certain specific embodiments, it is understood that various modifications and substitutions can be made in any of them within the scope of the appended claims which are intended also to include equivalents of such embodiments.

What is claimed is:

1. A tester module for testing cosmetic samples located at predetermined intervals on a tape comprising:

a housing having a base, outwardly extending side walls, one of the said walls having an aperture and a removable cover mounted over the walls to close the housing;

a tape take up reel and a tape supply reel mounted to the housing, said tape extending from the supply reel to the take up reel; and, means for driving the reels to expose a cosmetic sample adjacent the window.

2. A tester module in accordance with claim 1 further including:

a crank coupled to the take up reel and protruding from the housing to drive the tape from the supply reel past the aperture to the take-up reel with each movement of the crank presenting a new sample at the window.

3. A tester module in accordance with claim 1 further including:

a curved member located adjacent the aperture in the housing providing a backing to the tape when the cosmetic is sampled.

4. A tester module in accordance with claim 2 further including:

a wheel mounted concentrically with the take up reel having a plurality of spaced apertures mounted thereabout; and, the crank is coupled at one end to the take up reel on intermediate protruding portion to engage the spaced apertures in the wheel and drive the take up reel and an actuating portion at the other end.

5. A tester module in accordance with claim 1 wherein:

the housing comprises a base having walls extending outwardly along the periphery thereof, one of said walls having an aperture to expose the tape, upwardly extending cylindrical members for mounting the supply reel and take up reel thereon; and, a removable cover mounted to the base.

6. A tester module for testing cosmetic samples located at predetermined intervals on a tape comprising:

a housing having a tape supply reel and a tape take up reel mounted therein and a gear system to actuate the reels driving the tape from the supply reel to the take up reel;

the housing includes a base, side walls extending outwardly therefrom and a cover mounted over the walls, one of said walls including an aperture; and a pivotable window mounted over the aperture and including to a gear segment, said segment engaging the gear system to drive said tape when the window is closed presenting a sample adjacent the aperture.

7. A tester module in accordance with claim 6 wherein:

the gear system includes a drive gear meshing with the gear segment and with the main gear having a wheel portion with the tape from the supply reel wrapped thereabout as it is fed to the take up reel.

8. A tester module in accordance with claim 7 wherein:

the tape comprises a strip having parallel sides spaced a predetermined distance apart and a plurality of apertures located along each side of the tape to provide positive engagement with the tape.

9. A tester module in accordance with claim 7 further including:

a backing member mounted adjacent the aperture to permit backing of the strip as the cosmetic is sampled; and further including a large pulley mounted concentrically with the supply reel and a small pulley mounted concentrically with the take up reel and a belt engaging both pulleys.

10. A tester module in accordance with claim 1 further including:

a console wherein a plurality of modules are removably mounted therein.

11. A tester module for testing cosmetic samples comprising:

a housing having a removable cover and testing aperture;

a pivotable door covering the aperture and having a driving gear segment coupled thereto;

a gearing arrangement connected to the gear segment to be actuated thereby including a drive sprocket coupled thereto;

a supply reel having a strip including a plurality of samples mounted thereon, perforations along both edges thereof, and a liner covering said samples; and, a take up reel for the liner and a take up reel for the strip wherein opening the door drives the gear segment to actuate the sprocket wheel and drive the strip with a sample adjacent the aperture and the liner and strip onto the respective take up reels.

* * * * *